United States Patent [19]

Merenyi et al.

[11] 4,242,850

[45] Jan. 6, 1981

[54] METAL WATER TOWER

[75] Inventors: Miklos Merenyi; Laszlo Huszar; Janos Hidvegi, all of Budapest, Hungary

[73] Assignee: Vizügyi Tervezö Vállalat, Budapest, Hungary

[21] Appl. No.: 859,929

[22] Filed: Dec. 12, 1977

[51] Int. Cl.[3] ..... E04B 1/00; E04G 21/00

[52] U.S. Cl. ..... 52/745; 29/469; 220/5 A

[58] Field of Search ..... 220/1 B, 5 A, 18, DIG. 25, 220/855; 29/469, 429; 228/184; 52/745, 194

[56] References Cited

U.S. PATENT DOCUMENTS

| | | | |
|---|---|---|---|
| 858,177 | 6/1907 | Harry | 220/1 B |
| 2,341,100 | 2/1944 | Horton | 220/1 B |
| 2,358,805 | 9/1944 | Horton | 52/194 |
| 2,537,219 | 1/1951 | Girton | 220/5 A |
| 2,852,931 | 9/1958 | Bonet | 52/745 |
| 3,093,254 | 6/1963 | Sammarco | 220/5 A |
| 3,268,999 | 8/1966 | Wiggins | 52/745 |
| 3,422,628 | 1/1969 | McDonald | 220/1 B |
| 3,792,795 | 2/1974 | Silkora et al. | 220/18 |
| 3,912,103 | 10/1975 | Gerhard | 220/5 A |
| 4,080,916 | 3/1978 | Nastasic et al. | 29/469 |

FOREIGN PATENT DOCUMENTS

| | | | |
|---|---|---|---|
| 1245572 | 7/1967 | Fed. Rep. of Germany | 220/1 B |
| 187280 | 11/1966 | U.S.S.R. | 52/194 |
| 387109 | 9/1973 | U.S.S.R. | 52/745 |

*Primary Examiner*—Joseph Man-Fu Moy
*Attorney, Agent, or Firm*—Karl F. Ross

[57] ABSTRACT

A water tower can be erected by mounting each of a pair of generally two-dimensional support frames each having an upper portion and a pair of lower ground-engaging feet projecting therefrom for pivoting at the feet about a respective horizontal axis generally at ground level. Then the two frames are pivoted about their respective axes from down positions lying on the ground into up erect positions with the upper portions spaced horizontally apart. An upwardly open vessel intended for the eventual storage of water is then secured between the upper portions to fix the assembly of frames and vessel into a rigid assembly.

3 Claims, 13 Drawing Figures

METAL WATER TOWER

FIELD OF THE INVENTION

The invention relates to water towers constructed of metal wherein the term "water tower of metallic construction" refers to elevated containers of steel or sheet aluminum which are intended for the storage of water or any fluid.

BACKGROUND OF THE INVENTION

In general water towers are made of steel-reinforced concrete or of a prefabricated sheet sheel construction, normally in the shape of a ball, a cylinder, or a frustocone with a central support; water towers with multiple supports are also known wherein the containers of various form are supported about their peripheries with multiple columns.

OBJECT OF THE INVENTION

It is an object of the invention further to develop water towers with multiple supports.

SUMMARY OF THE INVENTION

The invention rests on the idea that two prefabricated basic elements are used over and over. Through the use of the solution according to this invention the setting-up of water towers at the site can be much simpler and cheaper than the hitherto known solutions.

Another advantage is that in certain cases the lessened weight can save production and transport cost.

The traditional method of erecting a water tower is either extremely time-consuming e.g. when a small crane assembles light elements at a modest height or the technical expense is very high since expensive and large cranes or an assembly mast at the site are used to lift the large and heavy elements.

In general and principally in remote regions and countries e.g. in developing lands, the transport of large cranes to the building site is extemely expensive if not impossible.

The main idea of the invention lies in the particular construction of prefabricated elements of the water tower which allows erection by use of simple winches and cables.

BRIEF DESCRIPTION OF THE DRAWING

The technical solution according to the invention is described in the attached drawing with reference to some advantageous examples. There is shown in.

SPECIFIC DESCRIPTION

The first specific element, which is always used in pairs, is the two-dimensional and two-footed support frame 1, the second element is formed by the spatially three-dimensional flanged elevated container element 2. By assembly of a plurality of the basic elements as well as by the use of the simplest support frame 1 it is possible to obtain a water level of approximately 20 m–35 m; use of the principle according to the invention in another general arrangement allows obtention of water towers havin a height between 35–70 m.

The contained volume of such an elevated container lies between 25 $m^3$ and 1,000 $m^3$, by adding together of the two basic elements it is possible to obtain storage capacities up to 20,000 $m^3$.

Figure 1:
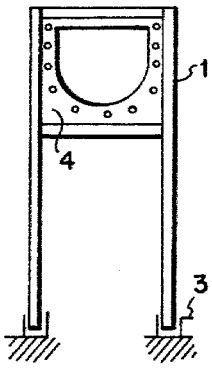
FIG. 1 a side view of an elevated container and its support frame.

FIG. 1 shows in side view the first basic element 1 which is practically a two-dimensional two-footed support frame that is always used in pairs. At the lower end of each foot there is provided a pivot 3 that is connected by means of a shaft with an element 15 (FIG. 4) anchored in the ground so that erection is possible by pivoting of the frame about its end. The feet are formed as tubes or square-section box girders.

The frame plate 4 establishes the stiffness of the frame as well as the possibility of connecting it to the elevated container, such connection being effected with screws in conjunction with screwholes shown in the figure or through welding.

Figure 2:
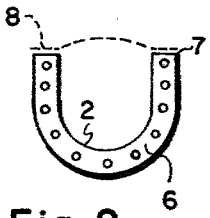
FIG. 2 a section through an elevated container.
Figure 3:
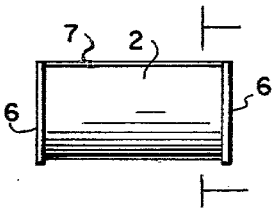
FIG. 3 a side view of the elevated container of FIG. 2.

As shown in FIGS. 2 and 3 the elevated container elements of sheet material is of U-section or of any upwardly open concave section, the element is provided on both of its upper edges 7 as well as on its end edges 6 with rigid flanges.

As a result of the above-described construction of the cross section numerous advantages can be obtained, thus for example production is simplified, connection between two basic elements can be made without difficulty, the supporting capacity is high, and the storage volume can be efficiently used.

The storage space can be covered by a curved or tensioned convering element 8.

Figure 4:
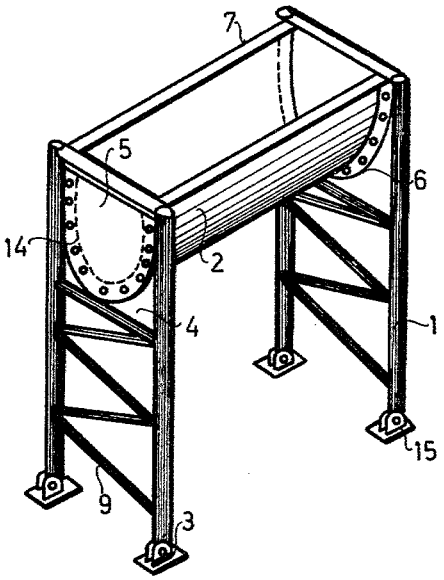
FIG. 4 an axonometric view of the basic construction elements.

FIG. 4 shows the simplest solution formed of two support frames 1 and an elevated container element 2; the necessary auxiliary elements, as for example the end plates 5, the struts 9 necessary in high towers, the connecting screws 14, the anchoring elements 15, as well as the pivot 3 with the connecting bolt and bearing are also shown.

FIGS. 5–8 show in plan view various arrangements which can be obtained by increasing the number of basic elements.

Figure 9:
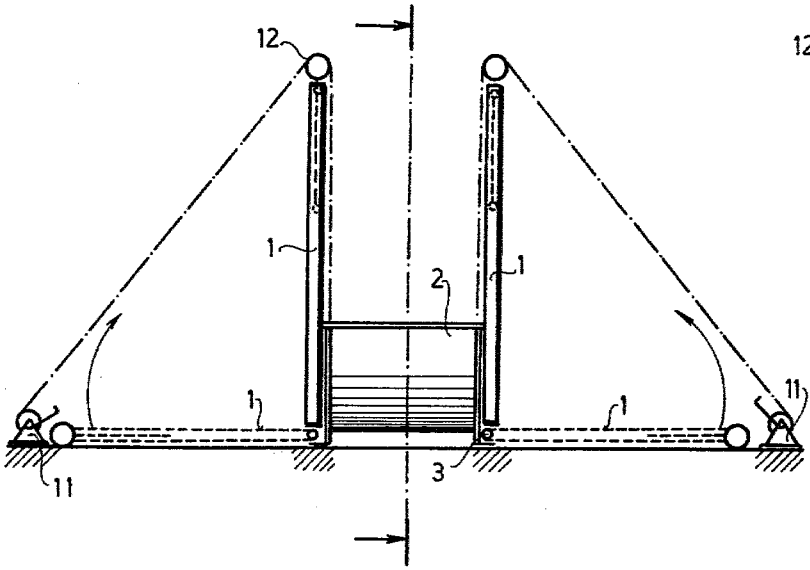
FIGS. 9–10 schematic views of the erection.
Figure 10:
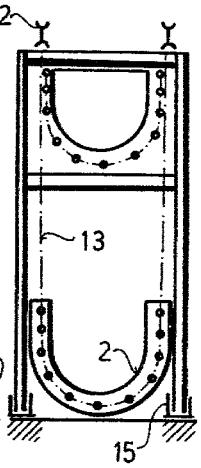
Figure 11:
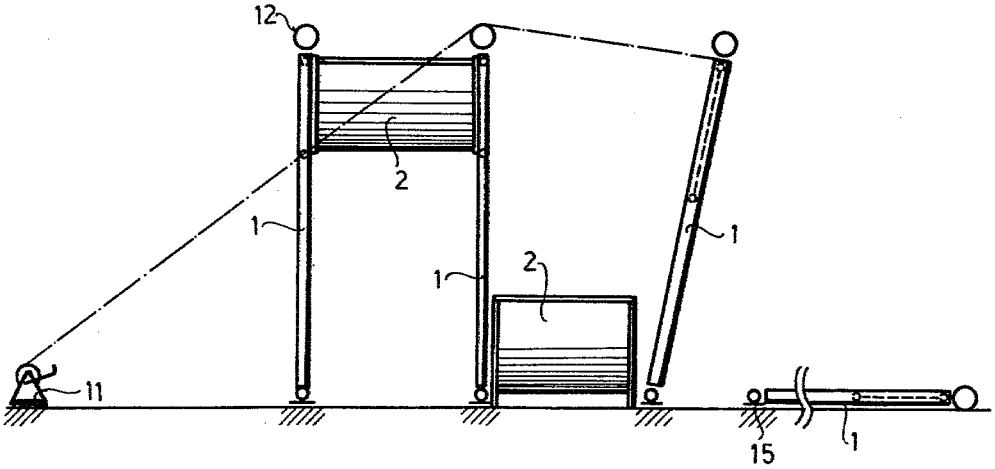

FIGS. 9–11 show a simple and inexpensive erection method which is possible through the use of the two specially constructed basic elements.

Figure 6:
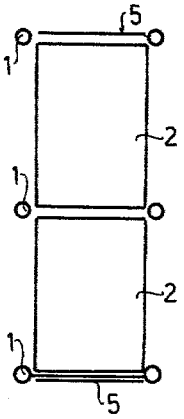
FIGS. 5–8 plan views of various arrangements.
Figure 5:
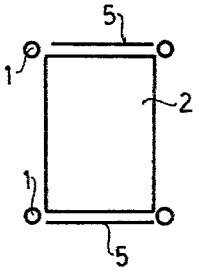

We give below further details on some embodiments:

As already mentioned FIG. 5 shows in top view the arrangement of FIG. 4. In the solution of FIG. 6 the storage volume is doubled by adding on a support frame 1 an elevated container element 2.

Figure 7:
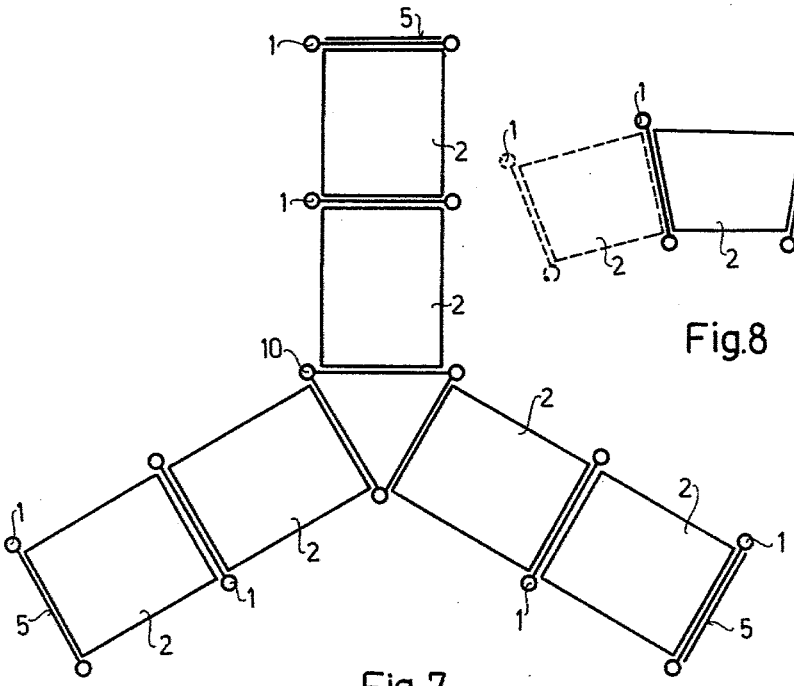

FIG. 7 shows a variation possibility wherein six support frames and six elevated container elements are used with specially built support elements 10.

Figure 8:
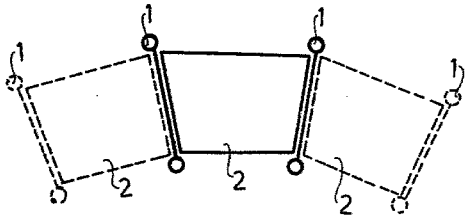

FIG. 8 shows an arrangement of polygonal or circular shape. As a result of the sequential assembly of the basic elements it is possible easier to follow the selected ground plan.

FIGS. 9 and 10 show the starting working steps for the erecting on the site; both frames 1 are mounted on the ground in horizontal positions; the foot pivots 3 are secured with bolts on the four anchors 15, the elevated container element 2 is placed between them and by means of motor-driven or manually-powered winches the two frames 1 one after the other are moved about the pivots 3 into the vertical positions.

In the vertical positions the support frames are temporarily secured with not-illustrated guy cables. After complete erection and securing of the support frames the elevated container element is lifted with four winches 11 and secured in its final position with screws 14. The cable serving for the lifting is passed over cable rollers 12 on the upper ends of the frame; in the last working steps the elements are welded together at their edges.

FIG. 11 shows the working step of lifting and erecting.

Figure 12:
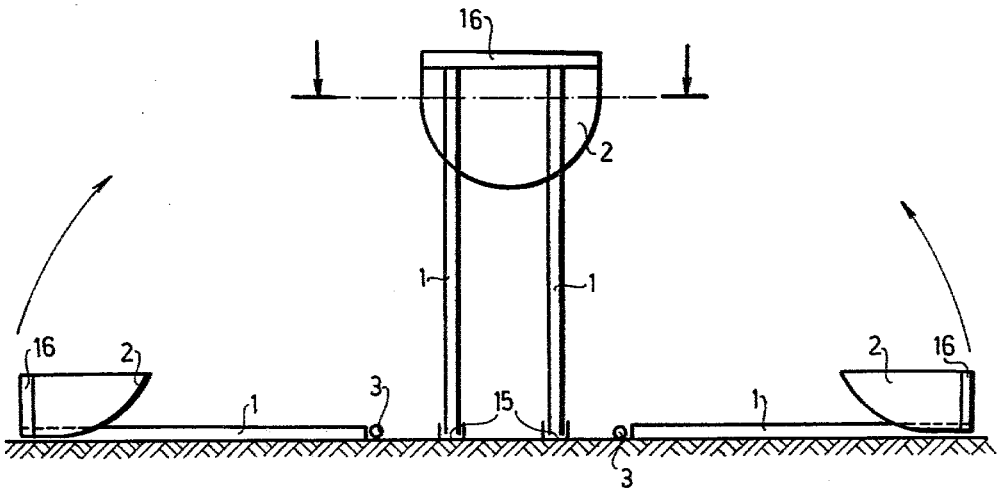
FIGS. 12–13 another erection or assembly method according to the invention.
Figure 13:
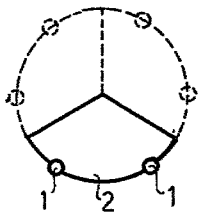

FIGS. 12 and 13 show another embodiment of the solution according to this invention.

According to this embodiment one-half, one-third, or one-fourth of the elevated container element 2 is assembled with the two-legged pivoted support frame 1. In order to ensure good stiffness of the thus assembled elevated container elements after complete assembly in accordance with the method shown in FIGS. 9–10, the last phase of the assembly is eased in that one-third or one-fourth portions of a circular or polygonal box girder 16 is secured to the upper edges of the elevated container elements.

After the erection of two, three, or more basic elements 1, 2 and after final fitting on of the individual parts of the annular or polygonal box girdles 16 the stiffness of the entire assembly is assured.

The horizontal box girder can serve as a working platform or for the hanging of further working platforms and greatly eases and simplifies the entire fitting-together of the plates of the elevated container for the welding operation.

The ladders, stairs, and feed conduits in the water tower are separately made for each installation.

The solutions according to the invention give numerous secondary advantages: as a result of the shape of the elevated container elements and their wall thickness the construction is subjected to tension stresses in one main direction and to bending stresses in another main direction.

The solution shown in FIGS. 12 and 13 can use a membrane as the wall of the container.

Through the use of the solution according to the invention it is possible to obtain a large saving in materials.

The prefabrication which takes place at an earlier time in the factory considerably reduces the amount of time for construction and on the other hand also reduces transport costs and preassembly costs at the site. Mainly this reduces the labor expense to one-third to one-fifth of the normal expense. Large crane set-ups are not necessary so that the assembly according to the invention can advantageously be used successfully in remote area, overseas and in developing lands where the transport of cranes is very difficult.

1. A method of making a water tower comprising the steps of sequentially:

mounting each of a pair of generally two-dimensional support frames each having an upper portion and a pair of lower ground-engaging feet projecting therefrom for pivoting about respective horizontal axes at ground level;

pivoting said frames about the respective axes from down positions each extending generally horizontally and lying on the ground into up positions each extending generally vertically with said upper portions spaced apart;

hoisting up an said frames in said up positions on upwardly open U-section trough and positioning same between said upper portions; and securing said U-section trough between said upper portions to form an upwardly open vessel and thereby fixing said frames and vessel together into a rigid assembly.

2. The method defined in claim 1 wherein said frames and vessel are fixed together by welding.

3. A method of making a water tower comprising the steps of:

mounting each of at least two generally two-dimensional support frames each having an upper portion and a pair of lower ground-engaging feet projecting therefrom for pivoting about respective horizontal axes at ground level;

providing at the upper portion of each of said frames a respective cup segment having a respective edge and capable of forming with the other cup segments an upwardly open vessel;

thereafter pivoting said frames about the respective axes from down positions each extending generally horizontally and lying on the ground into up positions each extending generally vertically with said upper portions juxtaposed; and thereafter securing together said cup segments at the edges thereof to form an upwardly open watertight vessel.

* * * * *